US008769930B2

(12) United States Patent
De Malet et al.

(10) Patent No.: US 8,769,930 B2
(45) Date of Patent: Jul. 8, 2014

(54) MOTOR VEHICLE EXHAUST SYSTEM

(75) Inventors: Etienne De Malet, Versailles (FR); Pascal Hottebart, Eragny (FR)

(73) Assignee: Renault S.A.S., Boulogne Billancourt (FR)

( * ) Notice: Subject to any disclaimer, the term of this patent is extended or adjusted under 35 U.S.C. 154(b) by 224 days.

(21) Appl. No.: 13/256,640

(22) PCT Filed: Feb. 26, 2010

(86) PCT No.: PCT/FR2010/050339

§ 371 (c)(1),
(2), (4) Date: Oct. 20, 2011

(87) PCT Pub. No.: WO2010/109104

PCT Pub. Date: Sep. 30, 2010

(65) Prior Publication Data

US 2012/0301364 A1 Nov. 29, 2012

(30) Foreign Application Priority Data

Mar. 23, 2009 (FR) ..... 09 51819

(51) Int. Cl.
*F02M 25/07* (2006.01)

(52) U.S. Cl.
CPC ..... *F02M 25/0703* (2013.01); *F02M 25/0719* (2013.01); *F02M 25/0735* (2013.01); *F02M 25/0709* (2013.01); *F01N 2470/14* (2013.01); *F01N 2470/18* (2013.01)
USPC ..... 60/278; 60/299; 60/320; 60/324

(58) Field of Classification Search
CPC ..... F02M 25/0703; F02M 25/0719; F02M 25/0735; F02M 25/0709; F01N 2470/14; F01N 2470/18
USPC ..... 60/296, 297, 298, 299, 301, 311, 320, 60/324, 278, 292
See application file for complete search history.

(56) References Cited

U.S. PATENT DOCUMENTS 4,924,668 A * 5/1990 Panten et al. ..... 60/278
6,213,105 B1 4/2001 Banzhaf et al.

(Continued)

FOREIGN PATENT DOCUMENTS

DE 10 2005 021397 1/2006
EP 0 916 837 5/1999
WO WO 2008068632 A2 * 6/2008

OTHER PUBLICATIONS

International Search Report issued Jun. 8, 2010 in PCT/FR10/050339 filed Feb. 26, 2010.

(Continued)

*Primary Examiner* — Thomas Denion
*Assistant Examiner* — Jorge Leon, Jr.
(74) *Attorney, Agent, or Firm* — Oblon, Spivak, McClelland, Maier & Neustadt, L.L.P.

(57) ABSTRACT

A motor vehicle exhaust system, including at least one pollutant-removing member, for example a catalytic converter or a particle filter, including a first outlet and connected to an exhaust line of an associated vehicle, and a second outlet for collecting exhaust gases with a view to recycling the same, the second outlet being connected to an inlet pipe of an exchanger for cooling exhaust gases, an outlet pipe of which is connected to a housing that receives a valve for controlling exhaust gases. The housing of the control valve includes a sole plate to be attached to an end sole plate of the outlet pipe of the exchanger, and the housing is attached directly onto a body of the exchanger.

10 Claims, 4 Drawing Sheets

(56) References Cited

U.S. PATENT DOCUMENTS

| | | | | |
|---|---|---|---|---|
| 6,598,388 | B2 * | 7/2003 | Lucas et al. | 60/311 |
| 6,748,736 | B1 * | 6/2004 | Claverie et al. | 60/298 |
| 7,195,060 | B2 * | 3/2007 | Martin et al. | 165/157 |
| 2002/0025282 | A1 * | 2/2002 | Atkinson | 422/173 |
| 2003/0150434 | A1 * | 8/2003 | Leedham et al. | 123/568.12 |
| 2006/0096281 | A1 * | 5/2006 | Huang | 60/297 |
| 2010/0043413 | A1 * | 2/2010 | Orihashi et al. | 60/320 |
| 2010/0146954 | A1 * | 6/2010 | Sloss et al. | 60/320 |
| 2010/0186397 | A1 * | 7/2010 | Emrich et al. | 60/320 |

OTHER PUBLICATIONS

French Search Report issued Nov. 2, 2009 in French Patent Application No. 09 51819 filed Mar. 23, 2009.

* cited by examiner

MOTOR VEHICLE EXHAUST SYSTEM

BACKGROUND

The invention relates to a motor vehicle exhaust system.

The invention relates more particularly to a motor vehicle exhaust system comprising at least one pollution-reducing member, notably a catalytic converter or a particle filter, comprising a first outlet connected to an exhaust line of an associated vehicle and a second outlet intended to tap off exhaust gases in order to recirculate them, said second outlet being connected to an inlet pipe of an exhaust gas cooler, an outlet pipe of which is connected to a casing housing an exhaust gas control valve.

Numerous examples of exhaust systems of this type are known.

In such a circuit, the casing housing the exhaust gas control valve is generally fixed to the engine block of the vehicle equipped therewith, via at least one strut and is connected to the outlet pipe of the cooler by a flexible pipe.

This design is relatively fragile because the vibrations to which the casing housing the control valve is subjected and the high temperature caused by the close proximity of the pollution-reducing member may cause the flexible pipe to degrade, thus leading to leaks that are detrimental to the correct operation of the vehicle engine.

Moreover, this design entails a relatively complex assembly operation because the cooler first of all has to be mounted on the pollution-reducing member, then the casing housing the control valve has to be mounted on the engine block and then the two of them have to be connected using the flexible pipe.

BRIEF SUMMARY

The invention overcomes this disadvantage by proposing a simplified method of assembly in which the casing housing the control valve is fixed directly to the body of the cooler.

To this end, the invention proposes an exhaust circuit of the type described hereinabove, characterized in that the casing housing the control valve comprises a flange intended to be fixed to an end flange of the outlet pipe of the cooler, and in that said casing is fixed directly to a body of the cooler.

According to other features of the invention:

- the body of the cooler is fixed to the pollution-reducing member,
- the pollution-reducing member comprises a body oriented substantially axially and a first end of which comprises an inlet pipe for the exhaust gases, of which at least one side wall comprises the first outlet of transverse orientation, and of which a second end comprises the second outlet of axial orientation and at least one transverse fixing wall intended to take the body of the cooler,
- the body of the cooler is substantially parallelepipedal, extends in the transverse direction, and comprises:
  - a horizontal lower face,
  - a rear face from which the inlet pipe projects, which is curved so that it extends under the horizontal lower face, and one end of which comprises a coupling flange,
  - a first transverse face for fixing to the transverse fixing wall of the body of the pollution-reducing member, comprising at least one first fixing lug for fixing to the transverse fixing wall of the body of the pollution-reducing member,
  - an opposite second transverse face from which there project an inlet pipe and an outlet pipe for the coolant,

- a horizontal upper face comprising at least a second lug in the form of angle bracket for fixing to the transverse fixing wall of the body of the pollution-reducing member, a third lug in the form of an angle bracket for fixing the casing housing the control valve, and the outlet pipe of the cooler,
- the second outlet of the pollution-reducing member is connected to the inlet pipe of the cooler by a bent intermediate pipe comprising a flange of axial orientation intended to be coupled to the second outlet of the pollution-reducing member and a flange of transverse orientation intended to be connected to the coupling flange of the inlet pipe of the cooler.

BRIEF DESCRIPTION OF THE DRAWINGS

Other features and advantages of the invention will become apparent from reading the detailed description which follows, for an understanding of which reference will be made to the attached drawings in which.

DETAILED DESCRIPTION

Figure 1:
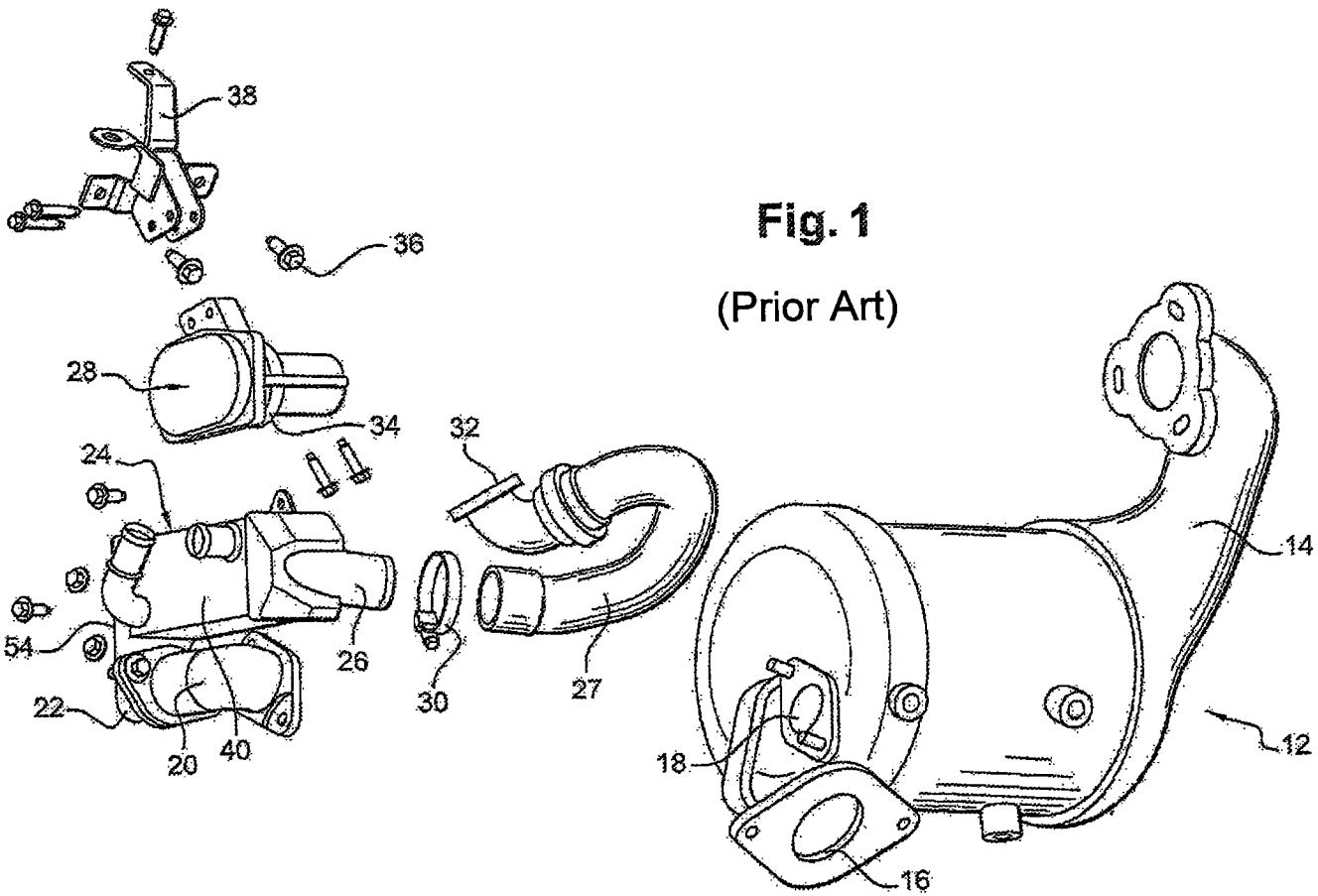
Fig. 1 (Prior Art)
FIG. 1 is an overall exploded perspective view of a system according to the prior art.
Figure 2:
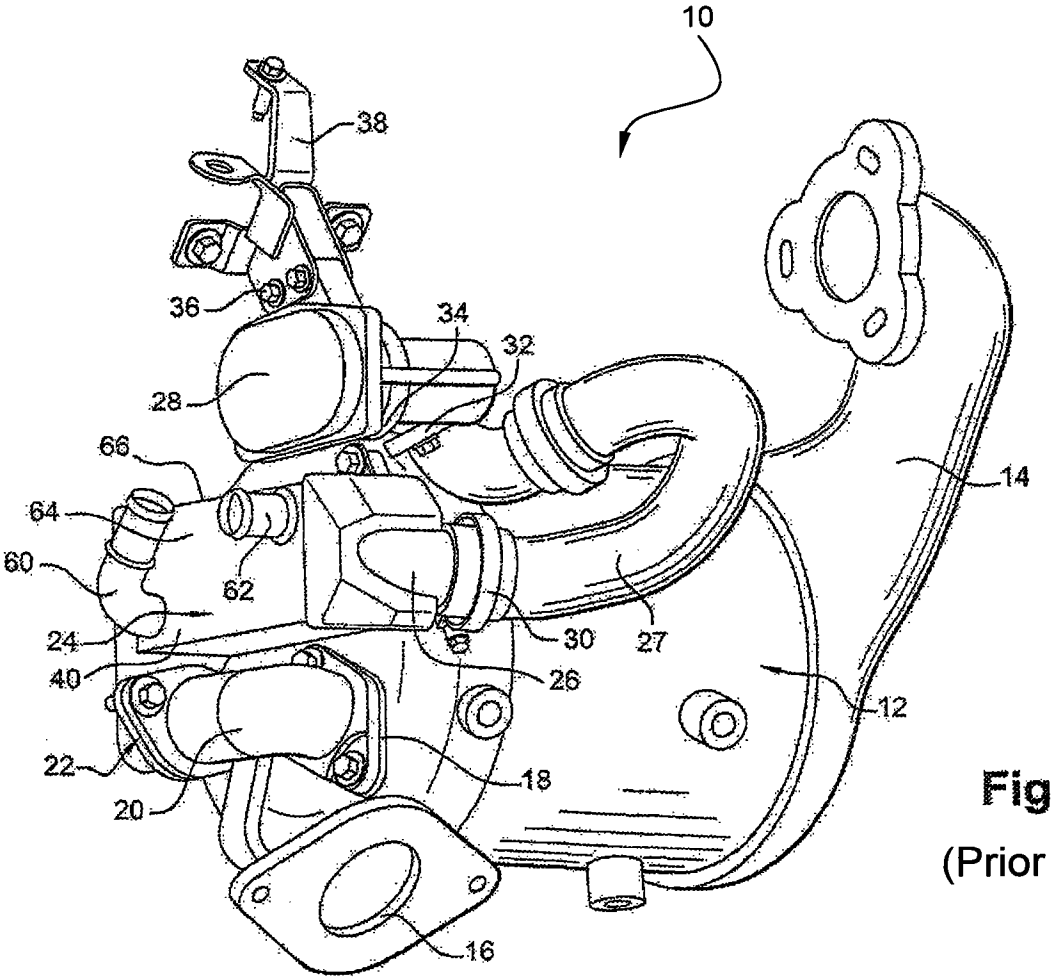
Fig. 2 (Prior Art)
FIG. 2 is an overall assembled perspective view of a system according to the prior art.

In the description that follows, identical reference numerals denote components that are identical or that have similar functions.

FIG. 1 depicts the entirety of a conventional motor vehicle exhaust system 10.

The system 10 is, for example, intended to be associated with an engine (not depicted) of a motor vehicle.

In the known way, the system 10 comprises at least one pollution-reducing member 12, notably a catalytic converter or a particle filter, comprising an exhaust gas inlet pipe 14, a first outlet 16 connected to an exhaust line (not depicted) of an associated vehicle, and a second outlet 18 intended to tap off exhaust gases so that they can be recirculated.

The second outlet 18 is connected by an intermediate pipe 20 to an inlet pipe 22 of an exhaust gas cooler 24. An outlet pipe 26 of the cooler 24 is connected to a casing 28 housing an exhaust gas control valve, by a flexible pipe 27.

The flexible pipe 27 comprises, for example, a collar clamp 30 to fix it to the outlet pipe 26 and a flange 32 to fix it to a flange 34 of the casing 28 of the control valve.

The casing 28 of the control valve is fixed by screws 36 to a strut 38 intended to be fixed to the vehicle engine.

With this design, the vibrations to which the casing 28 of the control valve, jutting out beyond the end of strut 38, is subjected and the high temperature induced by the close proximity of the pollution-reducing member 12, may cause the flexible pipe 27 to degrade. This degradation may cause leaks or the ingress of air, all of which are detrimental to the correct operation of the exhaust gas recirculation, thus disrupting the operation of the vehicle engine.

Moreover, this design entails a complicated and awkward assembly because it is necessary first of all to mount the cooler 24 on the pollution-reducing member 12, and then to mount the casing 28 housing the control valve on the strut 38 and the strut 38 on the engine block, before finally connecting them using the flexible pipe 27.

The invention overcomes this disadvantage by proposing the simplified assembly in which the casing 28 housing the control valve is fixed directly to the body 40 of the cooler 24.

Figure 3:
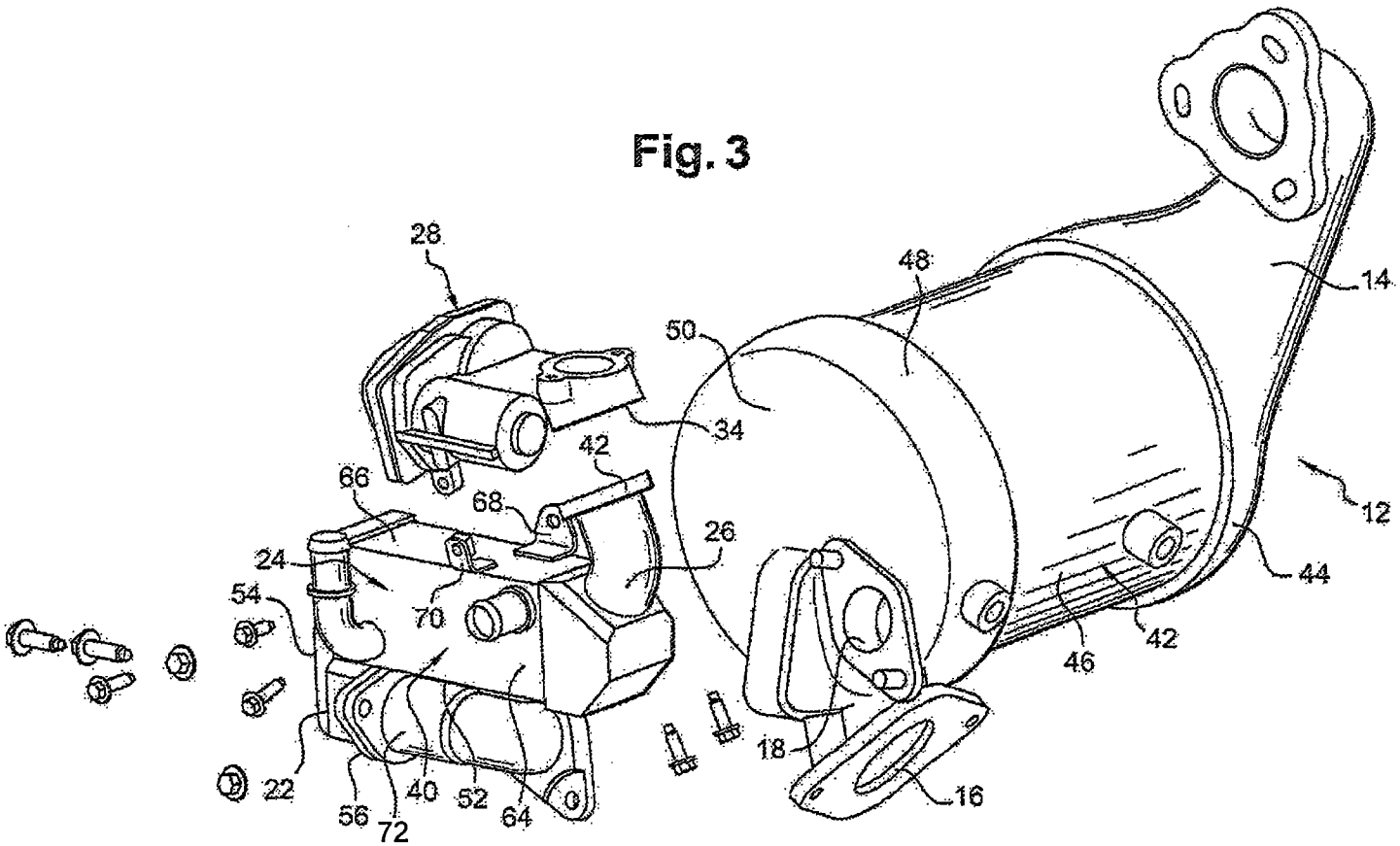
FIG. 3 is an overall exploded perspective view of a system according to the invention.
Figure 4:
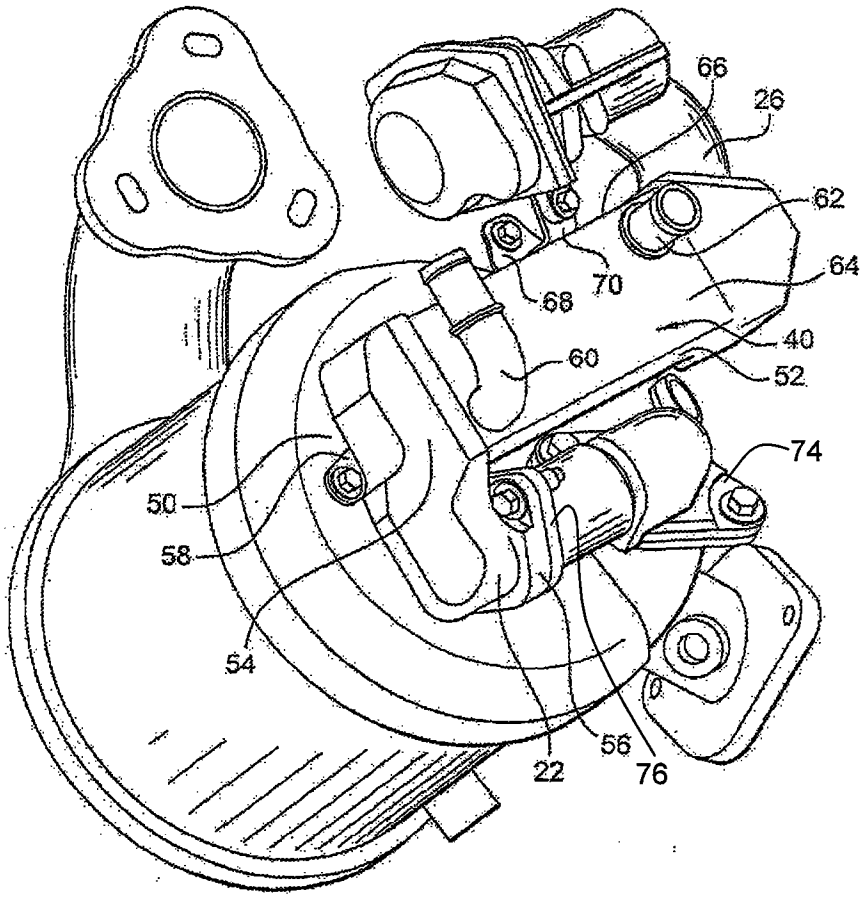
FIG. 4 is an overall assembled perspective view of a system according to the invention.

To this end, and as FIGS. 3 and 4 illustrate the invention proposes an exhaust system of the type described hereinabove, characterized in that the casing 28 housing the control valve comprises a flange 34 intended to be fixed to an end flange 42 of the outlet pipe 26 of the cooler 24, and in that said casing 28 is fixed directly to a body 40 of the cooler 24.

Advantageously, the body 40 of the cooler 24 is fixed to the pollution-reducing member 12.

In the preferred embodiment of the invention, the pollution-reducing member 12 comprises a body 42 oriented substantially axially and notably substantially cylindrical and a first end 44 of which comprises the inlet pipe 14 for the exhaust gases, of which at least one side wall 46 comprises the first outlet 16 of transverse orientation, and of which a second end 48 comprises the second outlet 18 of axial orientation and at least one transverse fixing wall 50 intended to take the body 40 of the cooler.

To complement this, the body 40 of the cooler 24 is substantially parallelepipedal and extends in the transverse direction.

The body 40 of the cooler 24 notably comprises a horizontal lower face 52. It also comprises a rear face from which the inlet pipe 22 projects, which is curved so that it extends under the horizontal lower face, and one end of which comprises a coupling flange 56 providing connection with the second outlet 18 of the pollution-reducing member.

The body 40 of the cooler 24 also comprises a first transverse face for fixing to the transverse fixing wall of the body of the pollution-reducing member, comprising at least one first fixing lug 58 for fixing to the transverse fixing wall 50 of the body of the pollution-reducing member 12.

An inlet pipe 60 and an outlet pipe 62 for the coolant project from an opposite second transverse face 64. These pipes 60, 62 are intended to be connected to a vehicle cooling circuit in order to cool the exhaust gases.

Finally, the body 40 of the cooler 24 comprises a horizontal upper face 66 comprising at least a second lug 68 in the form of angle bracket for fixing to the transverse fixing wall of the body of the pollution-reducing member, a third lug 70 in the form of an angle bracket for fixing the casing housing the control valve, and the outlet pipe 26 of the cooler 24.

In the preferred embodiment of the invention, the second outlet 18 of the pollution-reducing member 12 is connected to the inlet pipe 22 of the cooler 24 by a bent intermediate pipe 72 comprising a flange 74 of axial orientation intended to be coupled to the second outlet 18 of the pollution-reducing member and a flange 76 of transverse orientation intended to be connected to the coupling flange 56 of the inlet pipe 22 of the cooler 24.

In this configuration, assembly is performed as follows:

the intermediate pipe 72 is fixed to the pollution-reducing member 12, then the cooler 24 is fixed to the intermediate pipe 72 and the cooler 24 is then fixed to the pollution-reducing member 12. Finally, the casing 28 housing the control valve is fixed to the cooler 24.

The invention allows a considerable simplification of the assembly of an exhaust gas recirculation system.

The invention claimed is:

1. A motor vehicle exhaust system comprising:

at least one pollution-reducing member, including a body oriented substantially axially and a first end of which comprises an inlet pipe for exhaust gases, at least one side wall of the body including a first outlet that is of transverse orientation and that directs a first exhaust gas flow to an exhaust line of an associated vehicle and a second end of the body including a second outlet that is of axial orientation and that directs a second exhaust gas flow to an exhaust gas recirculation circuit of the associated vehicle, the second outlet carrying the second exhaust gas flow to an inlet pipe of an exhaust gas cooler, an outlet pipe of which carries the second exhaust gas flow to a casing housing an exhaust gas recirculation control valve, wherein the casing housing the exhaust gas recirculation control valve comprises a flange mated to an end flange of the outlet pipe of the cooler, and the casing is fixed directly to a body of the cooler, wherein the body of the pollution-reducing member includes at least one transverse fixing wall that attaches to the body of the cooler.

2. The exhaust system as claimed in claim 1, wherein the body of the cooler is substantially parallelepipedal, extends in the transverse direction, and comprises:

a horizontal lower face;

a rear face from which the inlet pipe projects, which is curved so that it extends under the horizontal lower face, and one end of which comprises a coupling flange;

a first transverse face for fixing to the transverse fixing wall of the body of the pollution-reducing member, comprising at least one first fixing lug for fixing to the transverse fixing wall of the body of the pollution-reducing member;

an opposite second transverse face from which there project an inlet pipe and an outlet pipe for a coolant;

a horizontal upper face comprising at least a second lug in a form of an angle bracket for fixing to the transverse fixing wall of the body of the pollution-reducing member, a third lug in a form of an angle bracket for fixing the casing housing the control valve, and the outlet pipe of the cooler.

3. The exhaust system as claimed in claim 2, wherein the second outlet of the pollution-reducing member is connected to the inlet pipe of the cooler by a bent intermediate pipe comprising a flange of axial orientation configured to be coupled to the second outlet of the pollution-reducing member and a flange of transverse orientation configured to be connected to the coupling flange of the inlet pipe of the cooler.

4. The exhaust system as claimed in claim 1, wherein the flange comprised in the exhaust gas recirculation control valve is bolted to the end flange of the outlet pipe of the cooler.

5. The exhaust system as claimed in claim 1, wherein an end side of the flange of the casing housing the exhaust gas recirculation control valve is connected to an end side of the end flange of the outlet pipe of the cooler.

6. The exhaust system as claimed in claim 1, wherein a first path for the first exhaust gas flow to the exhaust line of the associated vehicle is separate from a second path for the second exhaust gas flow to the exhaust gas recirculation circuit of the associated vehicle.

7. A motor vehicle including the system of claim 1.

8. A motor vehicle exhaust system comprising:

an exhaust gas cooler including an exhaust gas cooler body, an exhaust gas inlet pipe protruding out of the exhaust gas cooler body, and an exhaust gas outlet pipe protruding out of the exhaust gas cooler body, the exhaust gas outlet pipe including a flange;

a casing for an exhaust gas recirculation valve, the casing including a flange mated to the flange of the outlet pipe of the exhaust gas cooler, the casing being fixed directly to the body of the exhaust gas cooler; and a pollution-reducing member including a pollution-reducing member body oriented substantially axially, the pollution-reducing member body including a first end having an inlet pipe for exhaust gases, a transverse fixing wall that attaches to the exhaust gas cooler body, at least one side wall having a first outlet that is of transverse orientation and that directs a first exhaust gas flow to an exhaust line of an associated vehicle, and a second end having a second outlet that is of axial orientation and that directs a second exhaust gas flow to an exhaust gas recirculation circuit of the associated vehicle.

9. The motor vehicle exhaust system of claim 8, wherein the second outlet taps off exhaust gases to carry the exhaust gases into the exhaust gas inlet pipe of the exhaust gas cooler.

10. A motor vehicle including the motor vehicle exhaust system of claim 9.

* * * * *